US007261209B2

(12) United States Patent
Duncan et al.

(10) Patent No.: US 7,261,209 B2
(45) Date of Patent: Aug. 28, 2007

(54) MULTI-DISC MODULE AND METHOD OF APPLICATION

(75) Inventors: Kim R. Duncan, Eugene, OR (US); Roger D. Korstad, Eugene, OR (US)

(73) Assignee: Bulk Handling Systems, Inc., Eugene, OR (US)

( * ) Notice: Subject to any disclaimer, the term of this patent is extended or adjusted under 35 U.S.C. 154(b) by 121 days.

(21) Appl. No.: 11/026,701

(22) Filed: Dec. 31, 2004

(65) Prior Publication Data

US 2006/0180524 A1 Aug. 17, 2006

(51) Int. Cl.
*B07B 13/00* (2006.01)
*B07C 5/12* (2006.01)

(52) U.S. Cl. ..... 209/672; 209/667; 209/671; 209/271

(58) Field of Classification Search ..... 209/672, 209/671, 667, 271; 29/895.2, 895.21, 895.213, 29/525.01; 492/38, 40; 403/204, 286, 293
See application file for complete search history.

(56) References Cited

U.S. PATENT DOCUMENTS

| | | | | | |
|---|---|---|---|---|---|
| 409,426 | A * | 8/1889 | Reeves | 474/98 |
| 1,679,593 | A * | 8/1928 | Williamson et al. | 209/672 |
| 2,838,329 | A * | 6/1958 | Pressley | 403/204 |
| 3,306,441 | A * | 2/1967 | Sanders et al. | 209/672 |
| 3,817,375 | A * | 6/1974 | Herkes | 209/673 |
| 4,239,119 | A * | 12/1980 | Kroell | 209/672 |
| 4,301,930 | A * | 11/1981 | Smith | 209/671 |
| 4,538,734 | A * | 9/1985 | Gill | 209/668 |
| 4,606,494 | A * | 8/1986 | Kroell | 228/182 |
| 4,795,036 | A * | 1/1989 | Williams | 209/667 |
| 4,972,959 | A * | 11/1990 | Bielagus | 209/672 |
| 5,051,172 | A * | 9/1991 | Gilmore | 209/672 |
| 5,152,402 | A * | 10/1992 | Matula | 209/672 |
| 5,163,564 | A * | 11/1992 | Matula | 209/672 |
| 5,960,964 | A | 10/1999 | Austin et al. | |
| 6,076,684 | A * | 6/2000 | Bollegraaf | 209/668 |
| 6,149,018 | A | 11/2000 | Austin et al. | |
| 6,264,043 | B1 * | 7/2001 | Mobley | 209/669 |
| 6,371,305 | B1 * | 4/2002 | Austin et al. | 209/672 |
| 6,460,706 | B1 * | 10/2002 | Davis | 209/672 |
| 6,834,764 | B2 * | 12/2004 | Kreft et al. | 209/673 |

* cited by examiner

*Primary Examiner*—Patrick Mackey
*Assistant Examiner*—Mark Hageman
(74) *Attorney, Agent, or Firm*—Marger Johnson & McCollom, P.C.

(57) ABSTRACT

A modular multi-disc assembly for use in material separation screens and a method of application to those screens are provided. The modular multi-disc assembly includes an inner securing hub that clamps onto the drive shaft of a material separation screen. The modular multi-disc assembly further includes an outer multi-disc module split into halves with each half mounting separately onto the inner securing hub. Multiple discs can be replaced at one time as opposed to replacing each individual disc in a typical screen. The inner securing hub spaces the outer multi-disc module away from the drive shaft so that the primary wear concern reduces to the resilient discs on the outer multi-disc module, allowing for multiple outer multi-disc module replacements before needing to replace the inner securing hub.

22 Claims, 6 Drawing Sheets

MULTI-DISC MODULE AND METHOD OF APPLICATION

FIELD OF THE INVENTION

This invention relates to an apparatus and method for separating various materials. In particular, this invention relates improvements in a disc screen.

BACKGROUND OF THE INVENTION

Disc or roll screens are used in the materials handling industry for screening flows of materials to remove certain items of desired dimensions. Disc screens are particularly suitable for classifying what is normally considered debris or residual materials. This debris may consist of soil, aggregate, asphalt, concrete, wood, biomass, ferrous and nonferrous metal, plastic, ceramic, paper, cardboard, paper products or other materials recognized as debris throughout consumer, commercial and industrial markets. The function of the disc screen is to separate the materials fed into it by size or type of material. The size classification may be adjusted to meet virtually any application.

Material separating screens, and more specifically the discs in those screens, have been modified to improve the efficiency of separating out material from flows of debris introduced to the screen. Examples of those modifications are found in U.S. Pat. No. 5,960,964 to Austin et al., U.S. Pat. No. 6,149,018 to Austin et al., and U.S. Pat. No. 6,371,305 to Austin et al., which are incorporated by reference herein.

Discs must be routinely replaced on material separating screens when the discs wear down due to the normal operation of the screen. Replacing each individual disc involves removing the worn discs by disassembling each disc into its two halves. New discs are then installed on the drive shafts, with each new half disc fastened to that half disc's corresponding other half.

A typical screen will employ around 600 individual discs. Removal and replacement of all these discs is time-consuming. The process also requires at least two workers to perform the removal and replacement because a first disc half is held in place on the drive shaft by one worker while a second worker attaches or removes the second disc half that attaches to the first disc half.

What is needed is a material separating screen that requires less time to perform replacement of discs and reduces the man-power required to perform the replacement.

DETAILED DESCRIPTION

Figure 1:
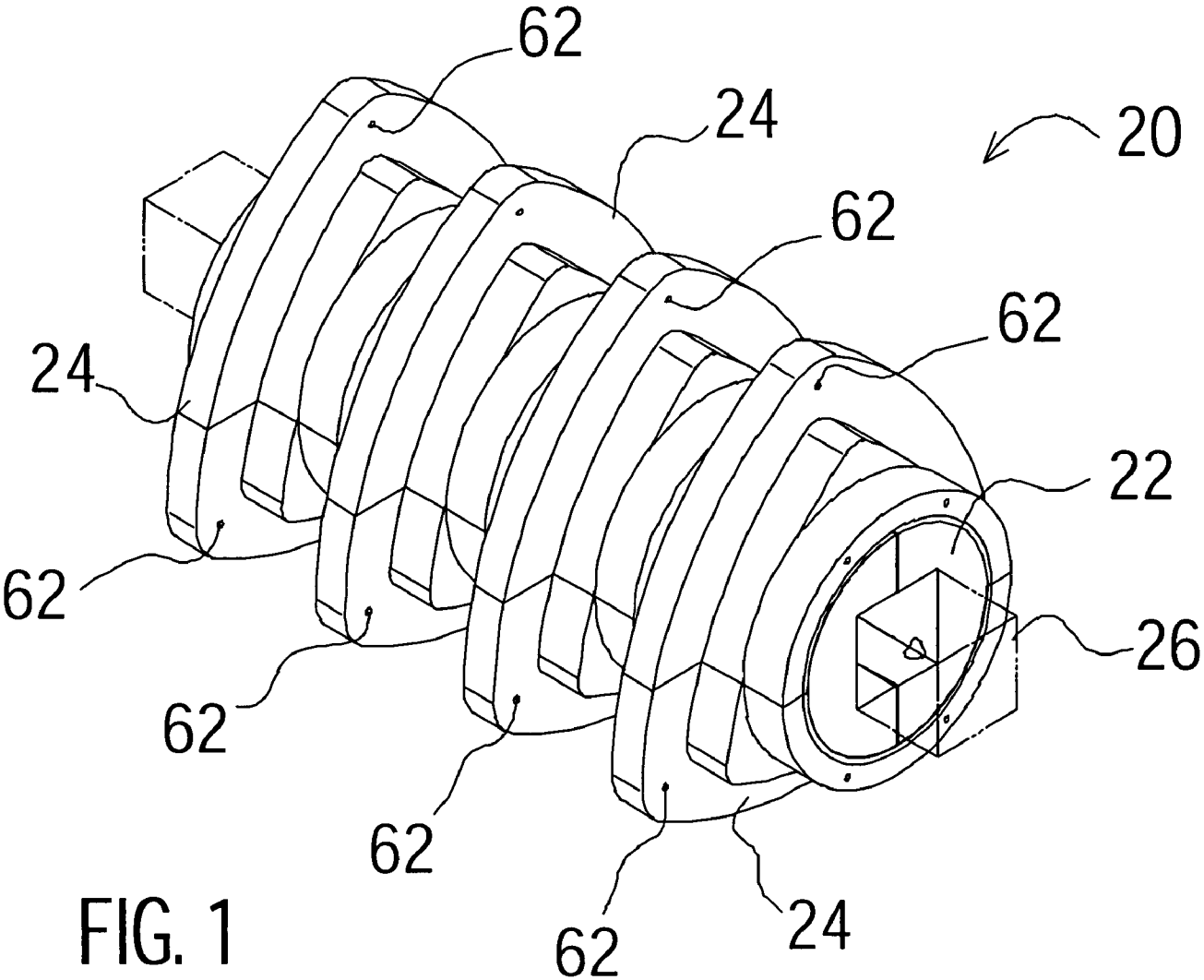
FIG. 1 is a perspective view of a modular multi-disc assembly mounted on a material separating screen drive shaft according to an embodiment of the invention.
Figure 2:
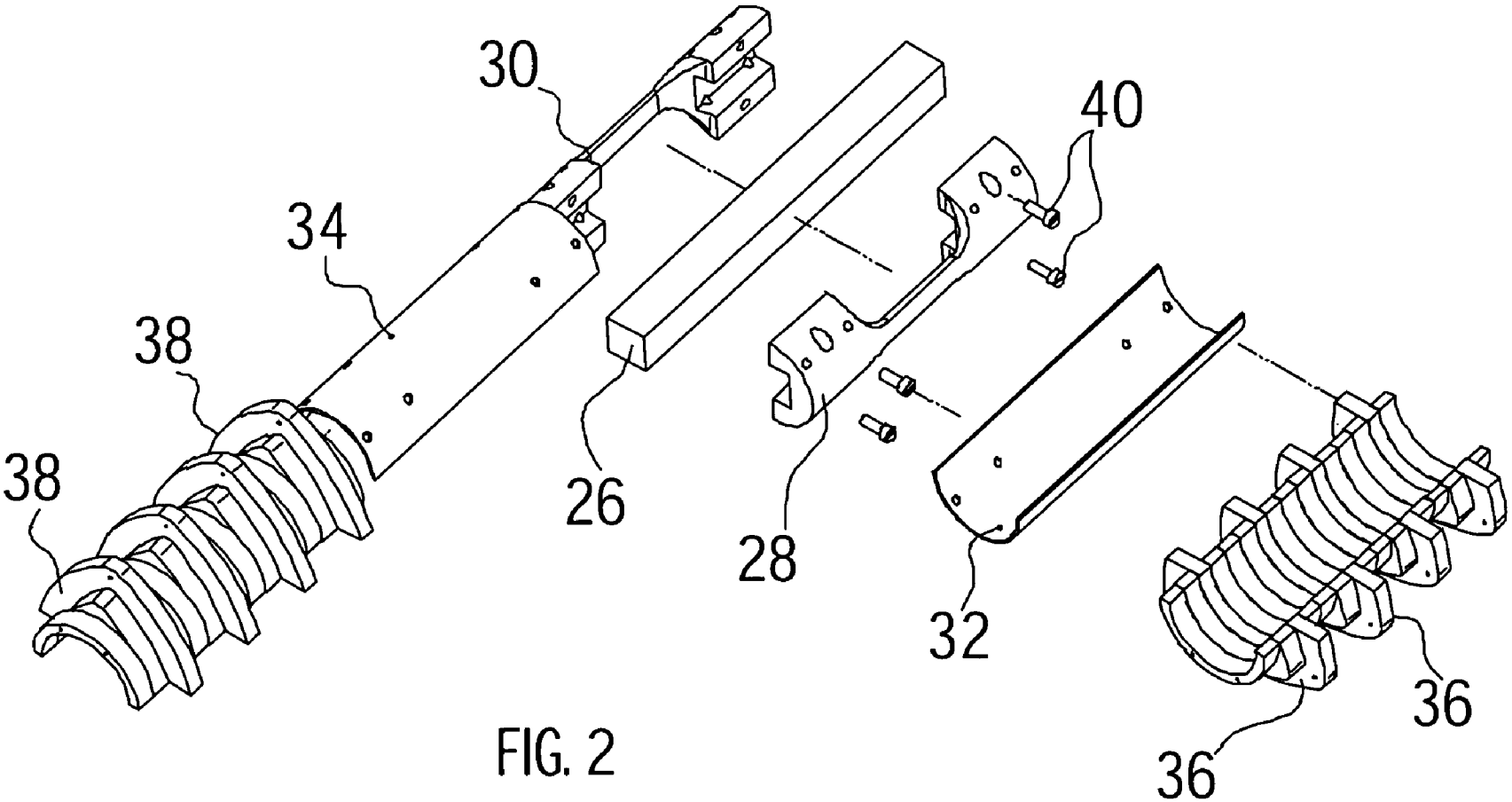
FIG. 2 is an exploded perspective view of the modular multi-disc assembly of FIG. 1.

FIG. 1 shows a perspective view of the modular multi-disc assembly 20 assembled on material separating screen drive shaft 26 (shown in phantom). FIG. 2 shows an exploded perspective view of the multi-disc assembly 20 and the drive shaft 26 (shown in phantom).

The modular multi-disc assembly 20 includes inner securing hub 22, which includes two securing hub halves 28 and 30, and outer multi-disc module 24, which includes two mounting plate halves 32 and 34 and two resilient molded surface multi-disc halves 36 and 38.

The inner securing hub 22 is sized and shaped to clamp around the square drive shaft 26. The outer multi-disc module 24 mounts onto the inner securing hub 22. The halves of the outer multi-disc module 24 are oriented around the longitudinal axis of the assembly 20 about ninety degrees to the inner securing hub halves 28 and 30. Mounting the outer multi-disc module 24 in this manner provides additional structural support and stability to the assembly 20.

Figure 3:
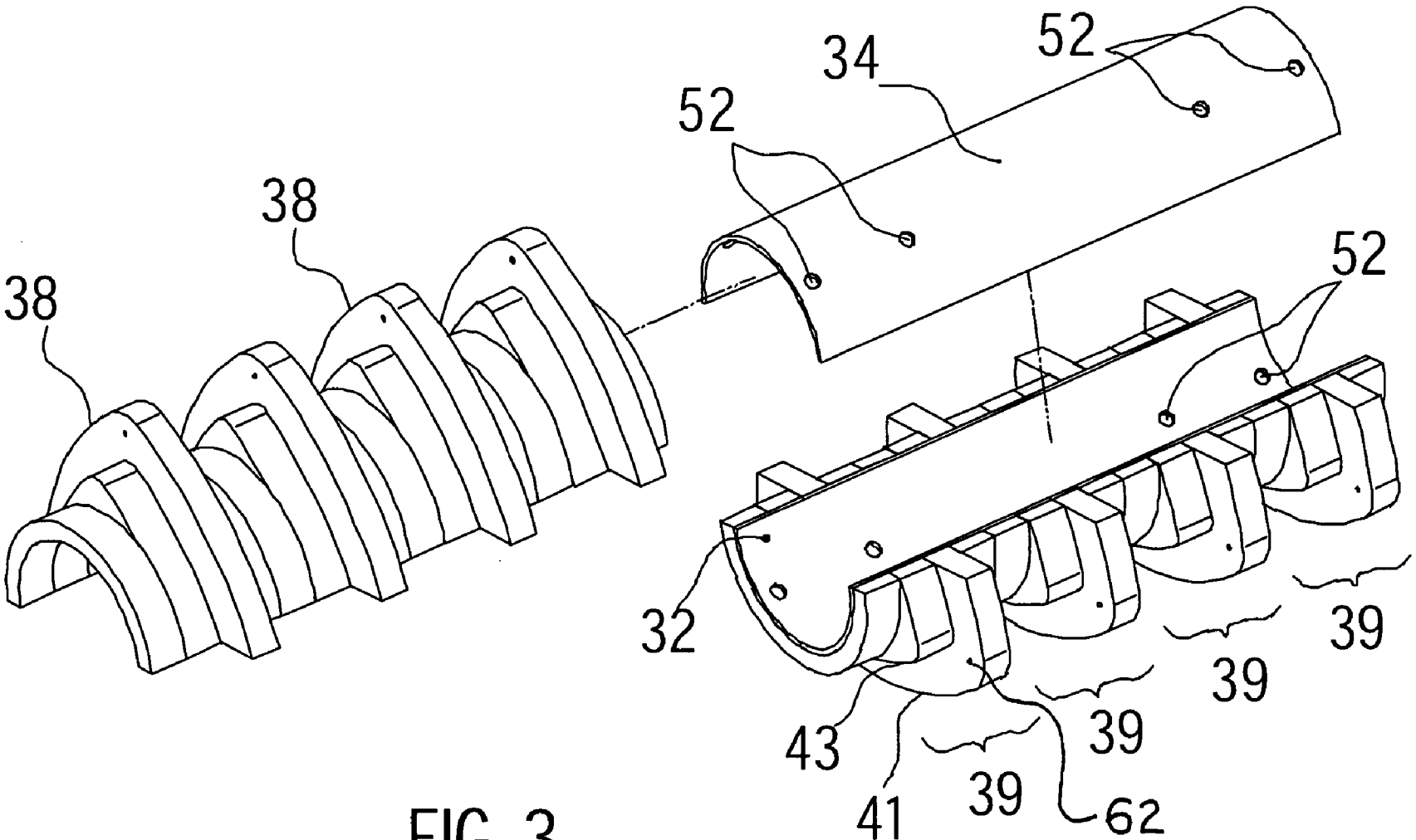
FIG. 3 is an exploded perspective view of an outer multi-disc module of the modular multi-disc assembly of FIG. 1.

FIG. 3 shows an exploded perspective view of the outer multi-disc module 24. The mounting plate halves 32 and 34 are formed to fit around the outer radius of the inner securing hub 22. The mounting plate halves 32 and 34 are preferably formed from a metal such as aluminum or steel.

The resilient molded surface multi-disc halves 36 and 38 are corresponding halves of multiple compound discs 39. Each compound disc 39 includes a major profile 41 and a minor profile 43. Alternatively, each multi-disc half 36 and 38 can include more than one major profile 41 and at least one minor profile 43. Most preferable, as shown in FIG. 3, four compound disc halves 39 are formed together to make a modular 4-disc assembly. However, modules of varying number of compound discs 39 are contemplated to be within the scope of the multi-disc assembly 20.

Each major profile 41 includes a wear indicator hole 62. When major profile 41 is worn down, wear indicator hole 62 becomes exposed alerting an operator of a material separating screen that the outer multi-disc module 24, or at least a half of the outer multi-disc module 24, on that part of the screen should be replaced.

Each resilient molded surface multi-disc half 36 and 38 is further molded onto the corresponding mounting plate halves 32 and 34.

Figure 4:
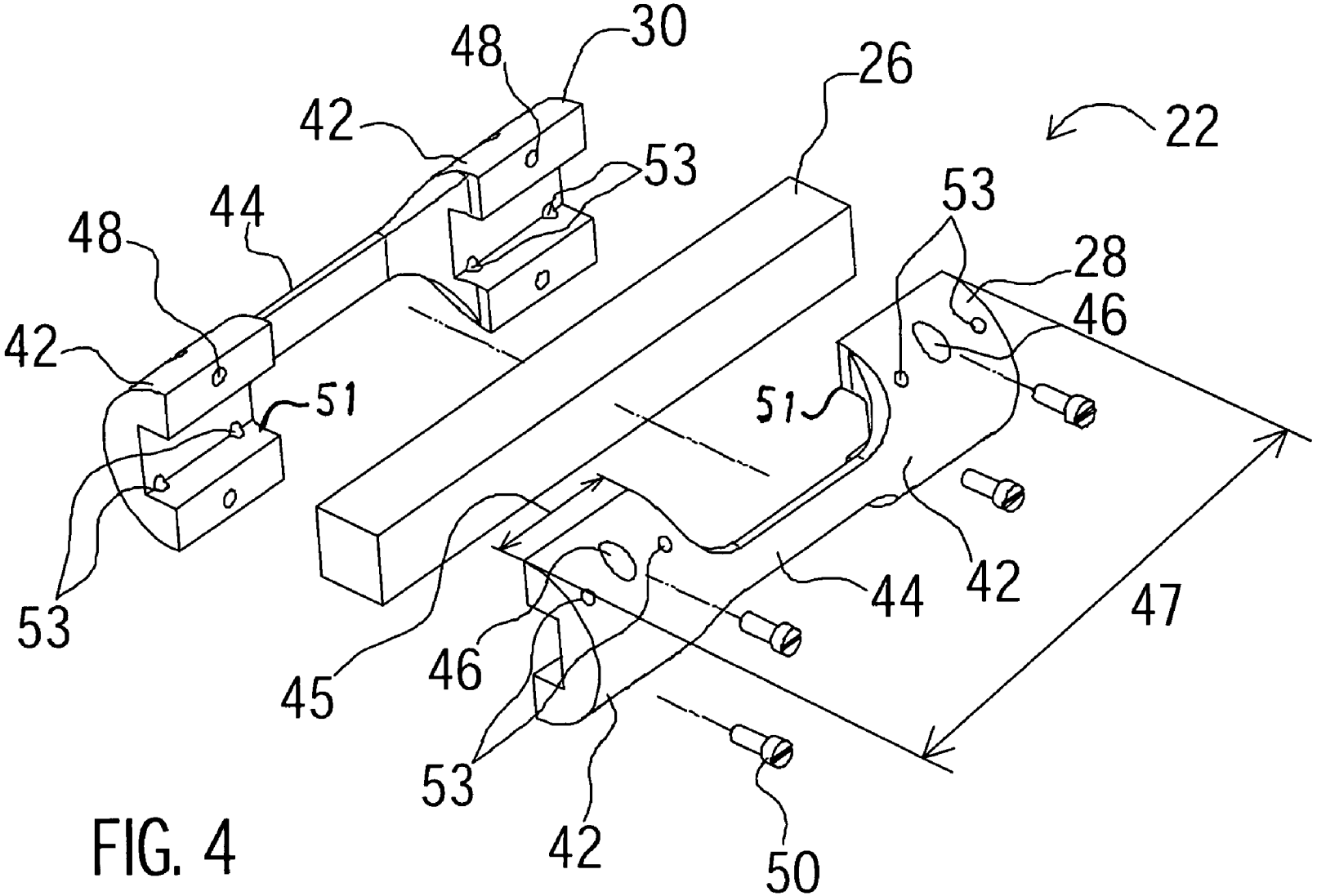
FIG. 4 is an exploded perspective view of a securing hub of the modular multi-disc assembly of FIG. 1.

FIG. 4 shows an exploded perspective view of the inner securing hub 22 with the drive shaft 26 shown in phantom. The inner securing hub 22 includes first and second securing hub halves 28 and 30, respectively.

Each inner securing hub half 28 and 30 includes disc module mounting portions 42. Preferably, each hub half 28 and 30 has two disc module mounting portions 42 positioned correspondingly at first and second longitudinal ends of each hub half 28 and 30. The mounting portions 42 are shaped to have an outer diameter spaced outwardly apart from an inner clamping portion 51 that is shaped to clamp around the drive shaft 26. Each mounting portion 42 has a length 45 less than the overall length 47 of the inner securing hub 22.

Each securing hub half 28 and 30 further includes an outer longitudinal portion 44 that extends between the mounting portions 42 and has an outer diameter matching the outer diameter of the mounting portions 42.

The inner securing hub 22 is preferably made from a metal material and is most preferably made from aluminum.

Each inner securing hub half 28 and 30 has mounting holes 46 and 48 used for clamping to each other and onto the drive shaft 26. Preferably, mounting holes 46 in the first hub half 28 are counter-sunk to receive fasteners 50, and mounting holes 48 in the second hub half 30 are tapped to threadingly receive fasteners 50 to clamp the inner securing hub 22 securely onto the drive shaft 26.

Each inner securing hub half 28 and 30 also includes disc mounting holes 53 that correspond to mounting holes 52 in the outer multi-disc module 24. Disc mounting holes 53 are preferably tapped to threadingly receive fasteners (not shown) that attach each half of the outer multi-disc module 24 to the inner securing hub 22. The disc mounting holes 53 are arranged on the inner securing hub half 28 and 30 to orient the halves of the outer multi-disc module 24 about ninety degrees to the inner securing hub halves 28 and 30 around the longitudinal axis of the assembly 20. Each half of the outer multi-disc module 24 can then be independently mounted onto the inner securing hub 22.

Figure 5:
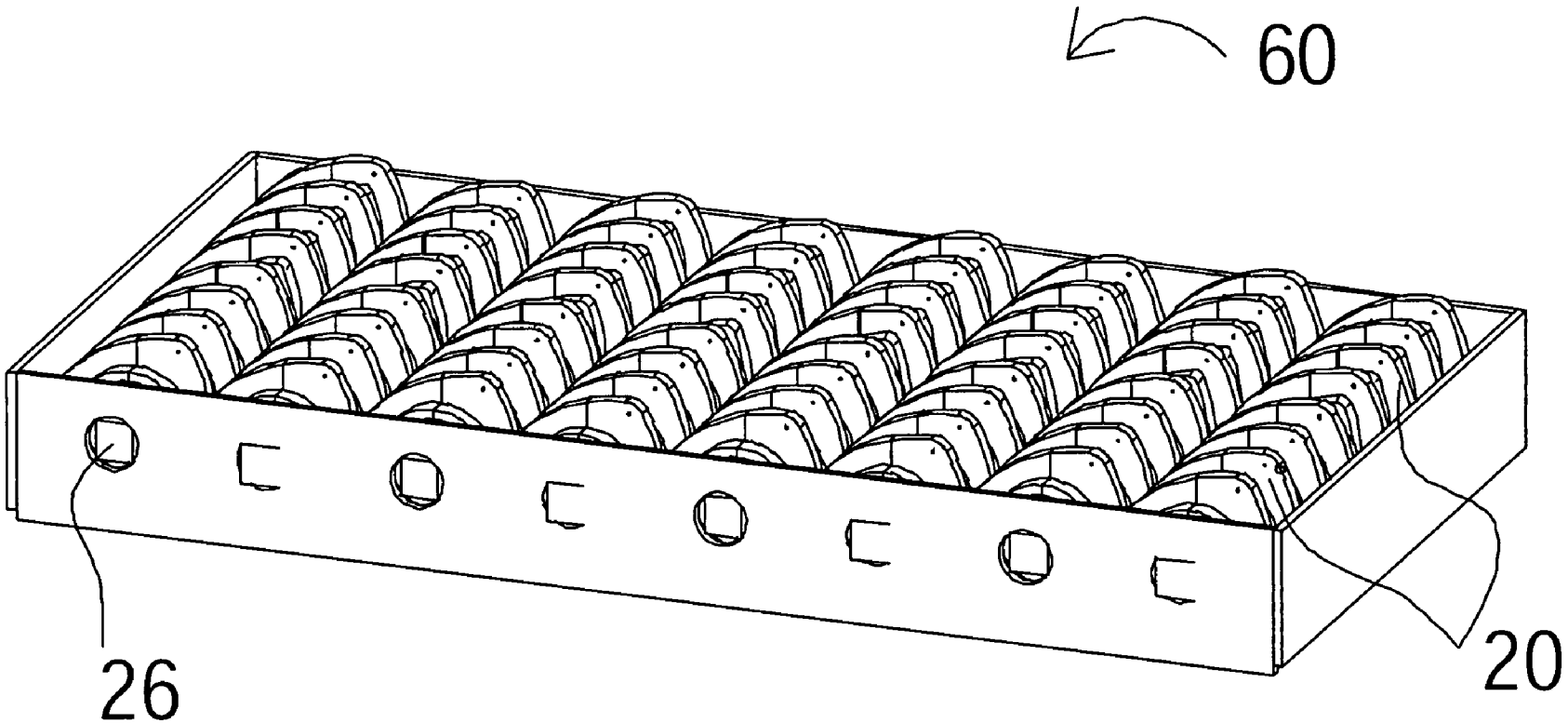
FIG. 5 is a simplified perspective view of a material separating screen utilizing modular multi-disc assemblies according to another embodiment of the invention.
Figure 6:
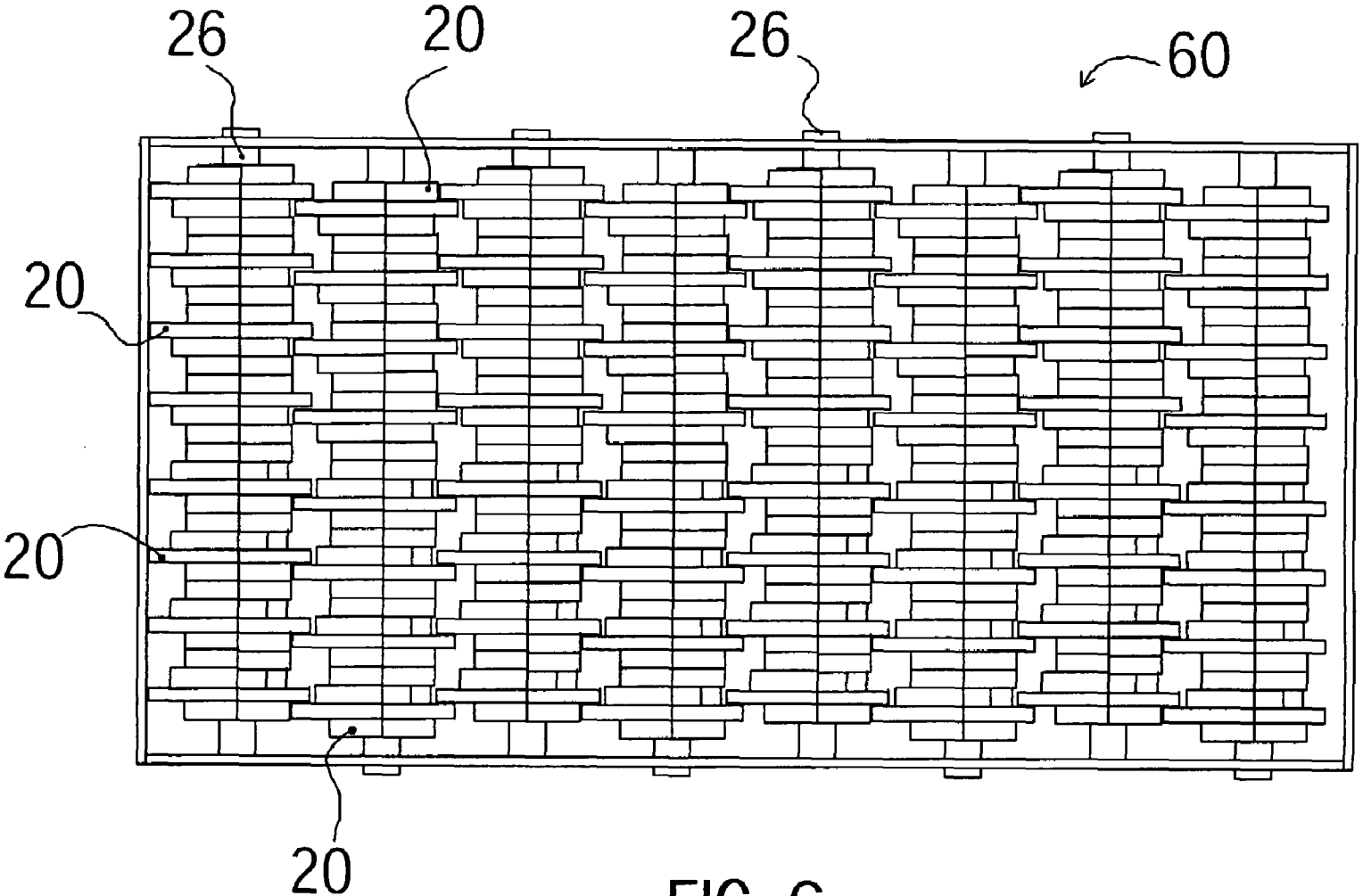
FIG. 6 is a top plan view of the simplified material separating screen of FIG. 5.

FIG. 5 is a simplified perspective view of a material separating screen 60 using the modular multi-disc assemblies 20 described above. FIG. 6 is a top plan view of the simplified screen 60. On typical screens, many modular multi-disc assemblies would be mounted on each drive shaft 26. In FIGS. 5 and 6, for illustration purposes, only two modular multi-disc assemblies 20 are shown mounted on each separate screen drive shaft 26. When the resilient discs wear down and require replacement, each half of each outer multi-disc module 24 can be removed from the inner securing hubs 22. Contrastingly, current screens require removal of each complete individual compound disc, with each individual disc comprising two half discs attached to the drive shaft 26 by clamping to each other.

In FIGS. 5 and 6, a single worker can remove an outer multi-disc half 36 or 38 by unfastening the disc half 36 or 38 from the inner securing hub 22, then rotating the drive shaft 26 and removing the other disc half in the same manner. Replacement of disc halves is similarly easily performed.

A method for mounting modular multi-disc assemblies on a material separation screen will now be described by referring to FIGS. 1 and 2.

Two inner securing hub halves 28 and 30 are mounted onto a material separation screen drive shaft 26. Then a first half of the outer multi-disc module 24 including a mounting plate half 32 and resilient multi-disc half 36 is mounted onto one side of the inner securing hub 22. Finally, a second half of the outer multi-disc module 24 including a mounting half plate 34 and resilient multi-disc half 38 is mounted onto the other side of the inner securing hub 22.

In allowing for mounting a first half of the outer multi-disc module 24 and then mounting a second half of the outer multi-disc module, an operator can also replace the first or second half of the outer multi-disc module 24 when one half of the module 24 wears more than the other half.

Mounting the halves of the outer multi-disc module 24 preferably includes fastening the halves to the inner securing hub 22 using mounting holes 52 on the outer multi-disc module 24 and corresponding disc mounting holes 53 on the inner securing hub 22. The disc mounting holes 53 are tapped to threadingly receive fasteners fastening the outer multi-disc module 24 onto the inner securing hub 22.

By mounting the outer disc module 24 on the inner securing hub 22, less structural material is wasted when the outer disc module 24 is replaced as compared to replacing a whole single disc, as is typically done. On typical screens using individual discs, the discs have a solid core beneath the resilient disc portion. When an individual disc wears out, the entire disc including the solid core is thrown away. In the embodiments presented above, initially only the resilient outer disc module 24 is replaced, leaving the inner securing hub 22 intact clamped to the drive shaft 26.

Further, less material is used in the inner securing hub 22 to transfer the rotational force of the drive shaft 26 to the outer disc module 24. As mentioned above, a typical single disc construction has a solid core of material between the resilient disc and the drive shaft. The inner securing hub 22 reduces the amount of material by mounting the outer disc module 24 on the disc module mounting portions 42 (shown in FIG. 4) located at the ends of the inner securing hub 22 that have a length 45 that is less than the overall length 47 of the inner securing hub 22.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment. Furthermore, the particular features, structures or characteristics may be combined as suitable in one or more embodiments of the invention.

Similarly, it should be appreciated that in the foregoing description of exemplary embodiments of the invention, various features of the invention are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

What is claimed is:

1. A modular multi-disc assembly for a material separation screen comprising:

an outer multi-disc module including multiple discs for use in a material separation screen; and an inner securing hub, wherein the inner securing hub is sized and shaped to mount onto a separation screen drive shaft and the outer multi-disc module is mounted on the securing hub, the outer multi-disc module further includes:

two mounting plate halves; and two resilient molded surface multi-disc halves, each multi-disc half including a corresponding half of multiple resilient discs and each multi-disc half mounted on one of the two mounting plate halves.

2. The assembly of claim 1, where each half of multiple resilient discs includes more than one major profile and at least one minor profile.

3. The assembly of claim 2, where each of the more than one major profile includes a wear indicator spaced radially inwardly from an outer edge of the major profile.

4. The assembly of claim 1, where each half of multiple resilient discs includes halves of multiple compound discs.

5. The assembly of claim 1, the inner securing hub further including two securing hub halves, where each securing hub half includes:

a disc module mounting portion having an outer diameter spaced outwardly apart from an inner clamping portion, the inner clamping portion sized and shaped to clamp around a material separating screen drive shaft; and an outer longitudinal portion having an outer surface substantially matching the outer diameter of the disc module mounting portion.

6. The assembly of claim 5, where each securing hub half includes two disc module mounting portions having longitudinal lengths less than a longitudinal length of the inner securing hub and positioned at first and second longitudinal ends, and where the outer longitudinal portion connects the two disc module mounting portions, the outer longitudinal portion extending longitudinally between the two disc module mounting portions.

7. The assembly of claim 5, where the outer multi-disc module includes mounting holes and the inner securing hub includes corresponding mounting holes, and where the outer multi-disc module is mounted on the inner securing hub by fastening the outer multi-disc module to the inner securing hub using the mounting holes on the outer multi-disc module and the inner securing hub.

8. The assembly of claim 7, where the mounting plate halves and the multi-disc halves of the outer multi-disc module are oriented about 90 degrees from securing hub halves of the inner securing hub around a longitudinal axis of the assembly.

9. The assembly of claim 5, where a first inner securing hub half includes counter-sunk drive shaft clamping holes, and a second inner securing hub half includes corresponding drive shaft clamping holes for clamping the securing hub halves onto the drive shaft.

10. A screen for separating material, comprising:

a frame;

multiple drive shafts mounted on the frame in a substantially parallel relationship with each other; and modular multi-disc assemblies mounted on each drive shaft, where the modular multi-disc assembly includes an inner securing hub clamped to the drive shaft and an outer multi-disc module mounted on the inner securing hub, and where the multi-disc module includes multiple discs for use in a material separation screen, where the outer disc module of the modular multi-disc assembly further includes:

two mounting plate halves; and two resilient molded surface multi-disc halves, each multi disc half including a corresponding half of multiple resilient discs and each multi-disc half mounted on one of the two mounting plate halves.

11. The screen of claim 10, where each half of the multiple resilient discs includes more than one major profile and at least one minor profile.

12. The screen of claim 11, where each of the more than one major profile includes a wear indicator spaced radially inwardly from an outer edge of the major profile.

13. The screen of claim 10, where each half of multiple resilient discs includes halves of multiple compound discs.

14. The screen of claim 10, where the inner securing hub of the modular multi-disc assembly further includes two securing hub halves, and where each securing hub half includes an outer disc module mounting portion having an outer diameter spaced outwardly apart from an inner clamping portion that is sized and shaped to clamp around a material separation screen drive shaft, and where each securing hub half further includes an outer longitudinal portion having an outer diameter matching the outer diameter of the outer disc module mounting portion.

15. The screen of claim 14, where each securing hub half includes two outer disc module mounting portions, each mounting portion having a longitudinal length less than an overall longitudinal length of the inner securing hub and positioned at first and second longitudinal ends, and where the outer longitudinal portion connects the two disc module mounting portions, the outer longitudinal portion extending longitudinally between the two disc module mounting portions.

16. The screen of claim 14, where the outer multi-disc module includes mounting holes and the inner securing hub includes corresponding mounting holes, and where the outer multi-disc module is mounted on the inner securing hub by fastening the outer multi-disc module to the inner securing hub using the corresponding mounting holes on the outer multi-disc module and the inner securing hub.

17. The screen of claim 16, where the mounting plate halves and the multi-disc halves of the outer multi-disc module are oriented about 90 degrees from securing hub halves of the inner securing hub around a longitudinal axis of the assembly.

18. The screen of claim 14, where a first inner securing hub half includes counter-sunk drive shaft clamping holes, and a second inner securing hub half includes corresponding drive shaft clamping holes for clamping the securing hub halves onto the drive shaft.

19. A method for mounting discs on a material separation screen, comprising:

mounting an inner securing hub to a material separation screen shaft;

mounting a multi-disc module onto the inner securing hub, the multi-disc module including multiple discs for use in the material separation screen, where mounting a multi-disc module includes mounting a first half of the multi-disc module to the inner securing hub and mounting a second half of the multi-disc module, and where the first half of the multi-disc module is mounted on the inner securing hub prior to mounting the second half of the multi-disc module.

20. The method of claim 19, where mounting each half of the multi-disc module includes fastening each half of the multi-disc module using mounting holes located on each half of the multi-disc module and corresponding mounting holes located on the inner securing hub.

21. A method for mounting discs on a material separation screen, comprising:

mounting an inner securing hub to a material separation screen shaft;

mounting a first half of a multi-disc module onto the inner securing hub; and mounting a second half of the multi-disc module, the multi-disc module including multiple discs for use in the material separation screen, where mounting the inner securing hub to a material separation screen shaft includes mounting a first half of the inner securing hub to a second half of the inner securing hub.

22. The method of claim 19, further comprising replacing a single half of the outer multi-disc module already mounted to the inner securing hub.

* * * * *